US006257917B1

(12) United States Patent
Hyzin

(10) Patent No.: US 6,257,917 B1
(45) Date of Patent: Jul. 10, 2001

(54) CONNECTOR LATCHING ARRANGEMENT

(75) Inventor: Peter Joseph Hyzin, Trabuco Canyon, CA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/613,799

(22) Filed: Jul. 11, 2000

(51) Int. Cl.[7] ..... H01R 13/627
(52) U.S. Cl. ..... 439/358
(58) Field of Search ..... 439/353, 357, 439/358, 157

(56) References Cited

U.S. PATENT DOCUMENTS

| | | | | |
|---|---|---|---|---|
| 2,514,246 | * | 7/1950 | Knox | 439/484 |
| 4,431,244 | | 2/1984 | Anhalt et al. . | |
| 4,448,467 | | 5/1984 | Weidler . | |
| 4,449,767 | | 5/1984 | Weidler . | |
| 4,984,998 | | 1/1991 | Duncan et al. | 439/352 |
| 5,011,425 | | 4/1991 | Van Zanten et al. | 439/353 |
| 5,030,127 | | 7/1991 | Blasko et al. | 439/353 |
| 5,100,339 | | 3/1992 | Sato et al. | 439/354 |
| 5,151,048 | | 9/1992 | Sato | 439/357 |
| 5,308,255 | * | 5/1994 | Yamanashi | 439/157 |
| 5,324,210 | | 6/1994 | Brickley | 439/372 |
| 5,344,335 | | 9/1994 | Scholz et al. | 439/357 |
| 5,382,177 | | 1/1995 | Hutchinson, Jr. et al. | 439/358 |
| 5,399,045 | | 3/1995 | Yoneda et al. | 403/321 |
| 5,591,042 | | 1/1997 | Takata et al. | 439/354 |
| 5,830,002 | | 11/1998 | Ito et la. | 439/358 |
| 6,065,989 | * | 5/2000 | Walkup et al. | 439/157 |

* cited by examiner

*Primary Examiner*—Neil Abrams
*Assistant Examiner*—Phuong KT Dinh
(74) *Attorney, Agent, or Firm*—Roger C. Turner

(57) ABSTRACT

An electrical connector assembly having a latching arrangement including a pair of latch arms pivotally connected to the sides of the plug connector body for pivotable movement about a common transverse axis extending through the sides. The pivotable arms have latching shoulders on their forward ends that engage catches formed on the inside of a mating receptacle connector.

5 Claims, 3 Drawing Sheets

CONNECTOR LATCHING ARRANGEMENT

BACKGROUND OF THE INVENTION

The present invention relates generally to an electrical connector assembly and, more particularly, to an improved latching arrangement for an electrical connector assembly.

It is common practice in the electrical connector art to provide on all plastic connectors integral latching arrangements which will allow positive locking together of the mating plug and receptacle connectors thereby assuring that electrical continuity is maintained under varying conditions of vibration and separating forces which would otherwise result in the loss of electrical continuity. Typically, the latching arrangement includes integral, molded-in levers that are pivotable about legs that extend laterally outwardly from the opposite sides of the housing of one of the connector halves, and embody latch shoulders which are engageable with catches on the outside of the mating connector half when the two halves are interengaged. While such latching arrangements are generally satisfactory, they have the disadvantage that because they extend outwardly from the opposite sides of the housing of the connector, the connector has a relatively high profile which may be objectionable if space is at a premium in the environment in which the connector is intended to be utilized.

U.S. Pat. No. 4,431,244 discloses a latching arrangement for an electrical connector assembly in which latch arms are formed by cutting slots in the upper and lower walls of the connector housing. The latch arms are pivotally mounted on the housing by integral live hinge pivots that extend laterally from the sides of the arms so that the arms are pivotable about transverse axes passing laterally through the upper and lower walls of the housing. While such an arrangement provides a low profile connector, the catches on the mating connector are formed on the outer wall of the connector housing, which is undesirable for some applications in which the mating connector must be mounted in an apparatus such that the exterior of the connector is inaccessible for receiving the latch arms from the first connector. Further, the latch arms operate independently of each other, rather than simultaneously with a single actuating motion of the user in one direction.

U.S. Pat. No. 4,984,998 discloses a latching arrangement for an electrical connector assembly in which latch arms are formed on the upper wall of the plug connector, while a hood is provided on the mating receptacle connector in which there are formed catches that are engaged by the latch arms. While the catches are formed on the interior of the receptacle housing, because they are formed on a hood forming part of the housing, and the latch arms of the plug are pivotable above the upper wall of the plug housing, the overall connector assembly has a relatively high profile, which is not desirable for some applications.

It is the object of the present invention to provide an improved latching arrangement for an electrical connector which has a low profile, the receptacle connector can be mounted in an environment where the exterior of the connector housing is inaccessible, and a single activating beam is associated with a pair of latch arms which allows the arms to be unlatched simultaneously with a single motion by the user from one side of the connector body, rather than activation from opposite sides as in most prior art latching arrangements for electrical connectors.

SUMMARY OF THE INVENTION

According to a principal aspect of the present invention, there is provided an electrical connector in which a pair of latch arms are pivotally connected to the respective sides of the connector body for pivotable movement about a common transverse axis extending through such sides. Each latch arm has a forward end formed with a latch shoulder that engages a catch formed within the interior of the mating connector housing so that such housing may have an uninterrupted rectangular outer configuration. This allows the mating connector to be mounted in a matching rectangular recess in an apparatus where the exterior of the housing is inaccessible. Preferably, an actuating beam is connected to the rear ends of the latch arms which allows the arms to be simultaneously actuated with a pushing motion in one direction by the user against the beam. The connector has a relatively low profile which is advantageous when the connector is used in applications in which there are substantial space constraints.

Other aspects and advantages of the invention will become more apparent from the following description taken in connection with the accompanying drawings.

DESCRIPTION OF THE PREFERRED EMBODIMENTS

Figure 1:
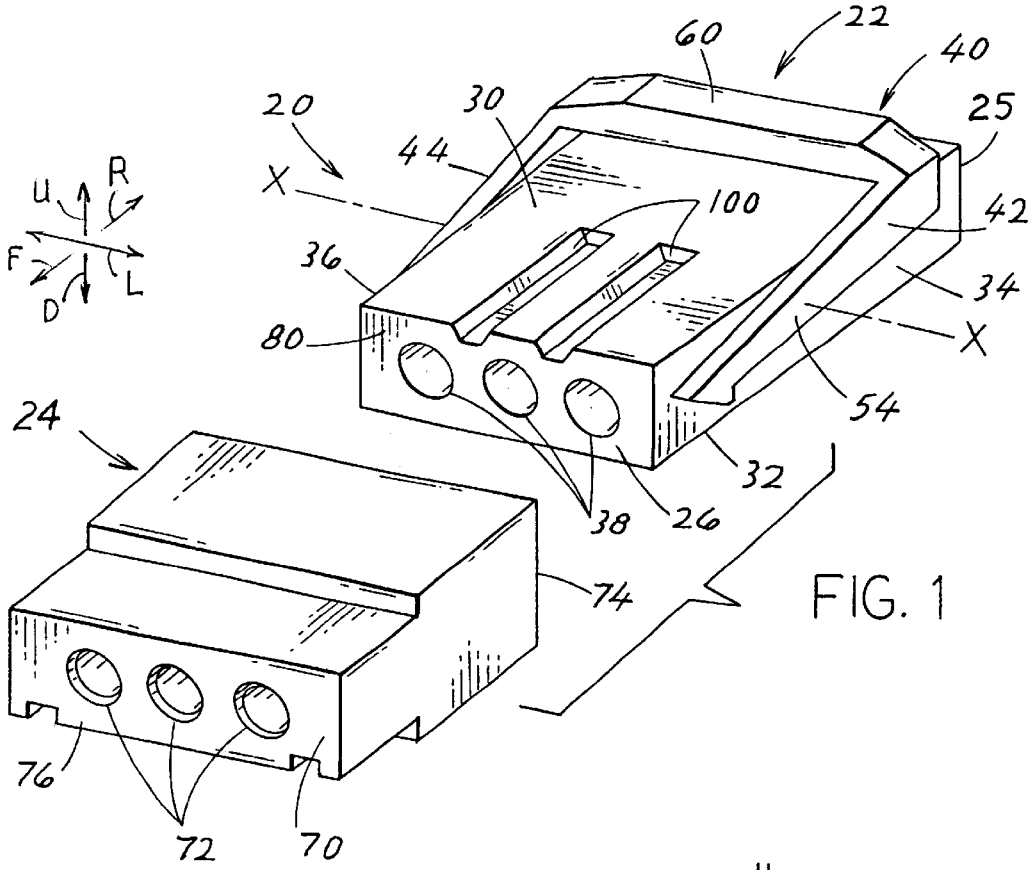
FIG. 1 is a perspective view of the mating plug and receptacle connectors of the electrical connector assembly of the present invention, shown in unmated condition.

Referring now to the drawings in detail, there is shown in FIG. 1 the connector assembly of the present invention, generally designated 20. Front and rear directions are indicated by arrows F and R, up and down directions are indicated by arrows U and D, and transverse, or lateral directions are indicated by arrows L. The connector assembly comprises a plug connector 22 and a mating receptacle connector 24. The plug connector 22 comprises a connector body or housing 25 of rectangular cross-section having a front face 26, rear face 28, upper surface 30, lower surface 32, and opposite sides 34 and 36. A plurality of contact passages 38 extend through the body 25 from the front face 26 to the rear face 28. Three of such passages are shown by way of example only. The contact passages are adapted to receive socket contacts, not shown.

The latch device 40 for the plug connector 22 comprises a pair of latch arms 42 and 44 pivotally mounted to the opposite sides 34 and 36, respectively, of the connector body 25. The latch arms 42 and 44 are identical. Hence, only the arm 42 will be described herein in detail.

Figure 2:
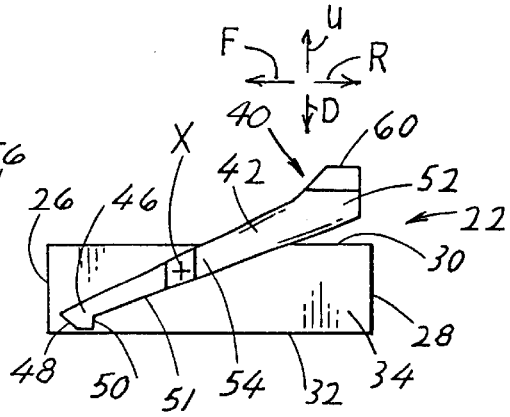
FIG. 2 is a side view of the plug connector shown in FIG. 1.
Figure 5:
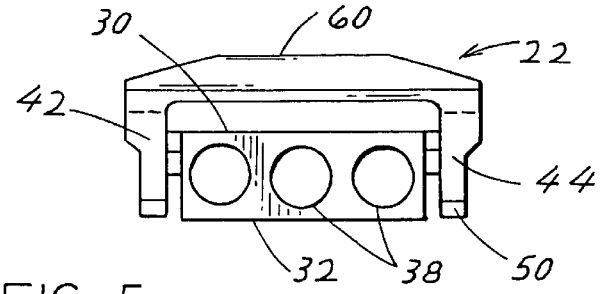
FIG. 5 is a rear view of the plug connector.
Figure 9:
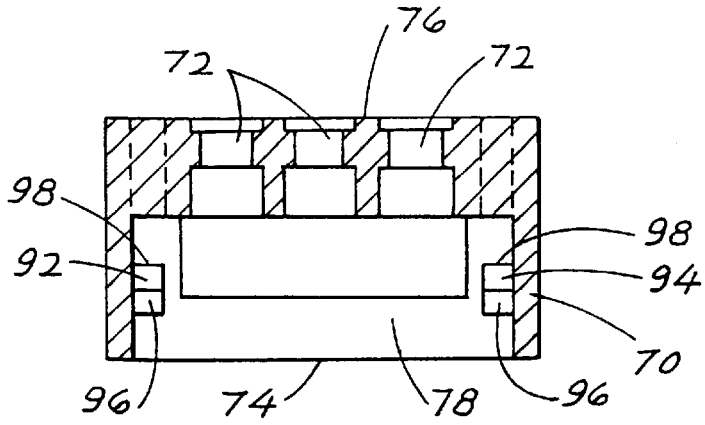
FIG. 9 is a sectional view taken along line 9—9 of FIG. 7.

The latch arm 42 extends generally diagonally, at forward and downward inclines relative to the side 34 of the connector body. The forward end 46 of the arm 42 is positioned adjacent to the front face 26 of the connector body and the lower surface 32 thereof. Preferably, the forward end 46 of the latch arm is at a level near or above the lower surface 32 of the connector body. As shown in FIG. 2, the forward end 46 of the arm is formed with a tapered, forwardly facing surface 48. A rearwardly facing latch shoulder 50 is provided on the bottom 51 of the latch arm behind the tapered surface 48. The rear end 52 of the latch arm is adjacent to the upper surface 30 and rear face 28 of the connector body. Preferably, the rear end of the arm 42 is positioned above the upper surface 30 as seen in FIG. 2. An intermediate part 54 of the latch arm 42 is pivotally connected to the side 34 of the connector body by a live hinge pivot 56.

The two latch arms 42 and 44 are pivotable about a common transverse axis X—X extending through the opposite sides 34 and 36 of the connector body so that the latch arms are pivotally movable in planes that are parallel to each other and parallel to the sides 34 and 36 of the plug connector body. The axis X—X extends through the sides of the body generally midway between the upper surface 30 and lower surface 32.

An actuating element or beam 60 extends transversely of the connector body above the upper surface 30 thereof, with its ends integrally joined to the rear ends 52 of the latch arms 42 and 44. It will be appreciated that by downward pressing of the beam 60 by the user, the latch arms will be caused to simultaneously pivot about the common axis X—X causing the forward ends of the arms 46 to be raised. The latch arm 42 extends at a forward and downward incline both when the beam is not pushed down and when the beam is pushed downward against the body upper surface 30.

Figure 7:
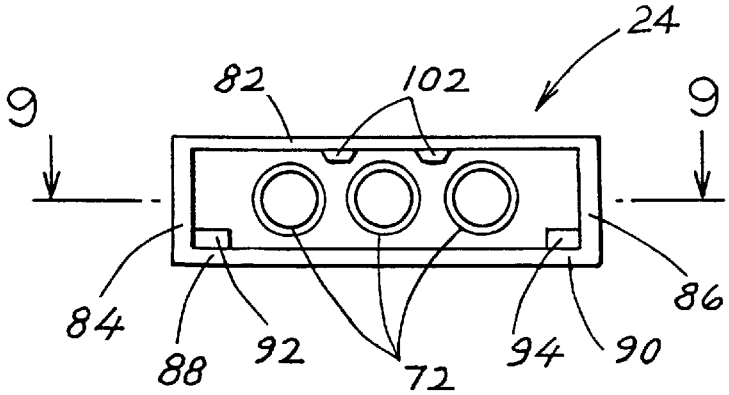
FIG. 7 is a front view of the receptacle connector.
Figure 6:
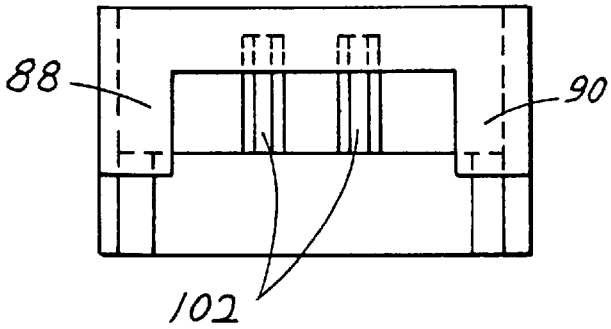
FIG. 6 is a bottom view of the receptacle connector shown in FIG. 1.
Figure 8:
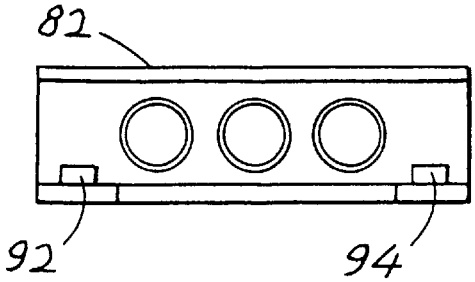
FIG. 8 is a rear view of the receptacle connector.

Reference is now made to FIGS. 1 and 6–9 of the drawings which show the mating receptacle connector 24. The receptacle connector comprises a connector body 70 having a generally rectangular cross-section and containing a plurality of contact passages 72 that extend from the rear face 74 to the front face 76 of the body. The number of contact passages 72 corresponds to the number of contact passages 38. The passages 72 would contain pin contacts, not shown. A rectangular-shaped recess 78 is formed in the rearward end of the receptacle body 70 with the recess opening rearwardly and configured to receive the forward mating end 80 of the plug connector 22, including the forward ends 46 of the latch arms 42 and 44. The recess 78 is formed by an upper wall 82, side walls 84 and 86, and inwardly extending flanges 88 and 90 as best seen in FIG. 7. Catches 92 and 94 are formed on the upper surfaces of the flanges 88 and 90 adjacent to the side walls 84 and 86, respectively, of the receptacle body between the front and rear faces of the body. The catches 92 and 94 are identical. Hence, only the catch 92 will be described in detail.

Figure 10:
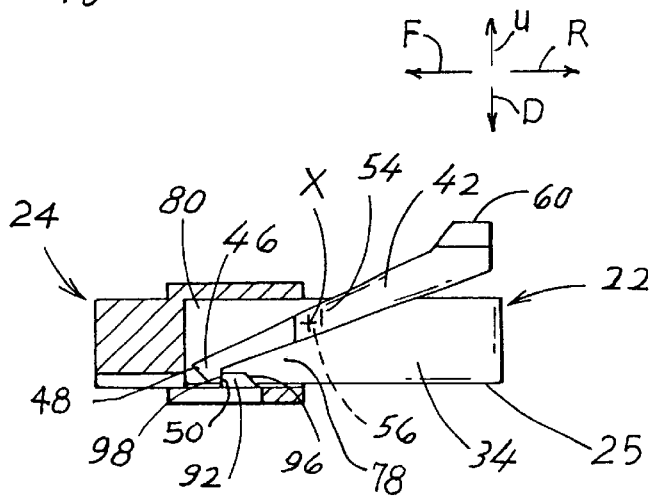
FIG. 10 is a partial vertical sectional view showing the plug and receptacle connectors in mated condition, with one latch arm engaged with a catch on the receptacle connector.

As best seen in FIG. 10, the catch 92 has a rearwardly facing inclined ramp 96 and a forwardly facing shoulder 98. The catch 92 is positioned within the receptacle body so that when the forward mating end 80 of the plug connector is initially pushed into the recess 78 in the receptacle connector body, the tapered riding surface 48 on the forward end 46 of the latch arm 42 will initially slide up over the ramp 96 on the catch 92. When the plug and receptacle connectors are fully mated, the latch shoulder 50 on the forward end of the latch arm snaps behind the shoulder 98 on the catch to firmly lock the plug and receptacle connectors together. As will be appreciated, the latch arm 44 on the opposite side of the plug body 25 cooperates with the catch 94 in the receptacle connector body in the same manner.

Figure 3:
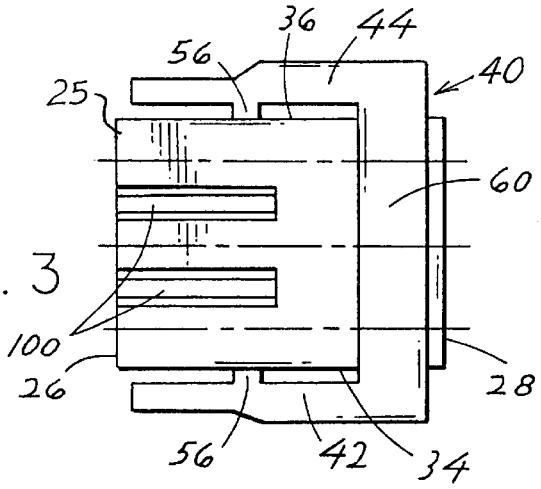
FIG. 3 is a top view of the plug connector.
Figure 4:
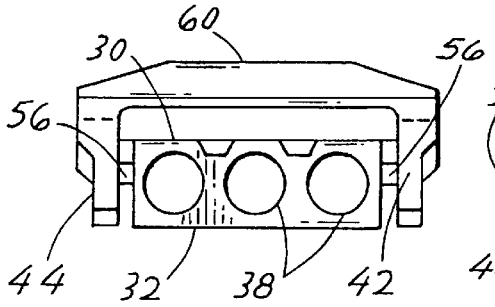
FIG. 4 is a front view of the plug connector.

As best seen in FIGS. 1 and 3, a pair of polarizing grooves 100 are formed in the upper surface 30 of the plug body 25 that slidably receive a pair of matching ribs 102 formed on the bottom of the upper wall 82 of the receptacle connector body for polarization of the plug and receptacle connectors. That is, the matching grooves 100 and ribs 102 ensure that the plug and receptacle connectors can be mated in only one position.

While the latching arrangement of the present invention has been described and shown as including two latch arms 42 and 44 on the plug connector, it is possible that a single latch arm could be mounted on the plug connector in a central region thereof. However, it is preferred that the plug connector have two latch arms to provide positive latching on opposite sides of the mating connectors, that ensures reliability of the latching connection. Because the catches 92 and 94 in the receptacle connector 24 are formed on the interior of the receptacle body, the body may have a clean rectangular outer configuration allowing it to be mounted in a matching rectangular recess in an apparatus where it is to be used. There is no necessity for the exterior of the receptacle connector 24—except for the front face thereof—to be accessible for engagement with latching arms as in most prior art latching arrangements for electrical connectors. The use of the single actuating beam 60 to pivot the two latch arms 42 and 44 ensures that the arms will be simultaneously pivoted to effectively disconnect the latching arrangement.

Furthermore, because the latch arms are mounted diagonally relative to the opposite sides of the plug body, and the rear ends of the arms and the actuating beam 60 are disposed only a relatively short distance above the rear surface of the plug body, the plug connector has a relatively low profile. Also, because the latch arms can be actuated by pressing in only a single direction on the actuating beam, it is not necessary for the user to grip the opposite sides of the plug connector to unlatch the same from the receptacle connector. Thus, by the design of the plug and receptacle connectors of the present invention, the assembly can be used in very confined environments.

What is claimed is:

1. A connector assembly which include a plug connector having a plug body with a front end and at least one contact-receiving passage, and a receptacle connector having a receptacle body with a recess that receives said plug body front end, said receptacle body having at least one contact holding passage, wherein:

said recess in said receptacle connector has walls forming a pair of opposite sides and a catch at each side, with each catch having a ramp extending at an upward and forward incline and having a largely rearwardly-facing catch shoulder lying forward of the ramp;

said plug connector includes a latch device with a pair of latch arms each having front and rear ends and a middle, with each arm being pivotally mounted on said plug body about a lateral axis extending through the latch arm middle, and said latch device includes a beam connected to said latch arm rear ends;

each latch arm front end having a riding surface that faces at least partially forwardly for riding up said ramp, and each latch arm front end having a primarily rearwardly-facing latch shoulder lying rearward of the riding surface for engaging said catch shoulder to prevent rearward movement of said latch arms until said arm front ends are raised by downward movement of said beam, with said latch arm front ends and said catches lying completely within said recess in said receptacle connector.

2. The connector assembly described in claim 1 wherein:

said plug connector has an upper surface, and said beam lies closely above said upper surface with said arms extending at downward and forward inclines both when said latch arm shoulders lie against said catch shoulder and when said latch arm shoulders lie above said catch shoulders, so said connectors can be released by merely pushing down said beam.

3. A connector assembly which includes a plug connector having a plug body with a front end and at least one contact-receiving passage, and a receptacle connector having a receptacle with a rearwardly-opening recess that receives said plug body front end, said receptacle body having at least one contact holding passage, wherein:

said receptacle connector has at least one catch in said recess with said catch having a largely forwardly-facing catch shoulder;

said plug connector includes a latch device with a latch arm that has a rear end and a handle thereat, and a front end with a largely rearwardly-facing arm shoulder;

said latch arm rear end lying rearward of and out of said recess, and said latch arm front end lying fully in said recess with said arm shoulder engaging said catch shoulder.

4. The connector assembly described in claim 3 wherein:

said recess has laterally opposite sides and has catch devices at each of said sides, with said catch forming one of said catch devices;

said latch device includes a pair of arm elements at laterally opposite sides of said plug connector, with said latch arm forming one of said arm elements;

said latch device includes a beam that connects front ends of said arm elements;

said plug connector has an upper surface, and said beam lies closely above said upper surface with said arm elements extending at downward and forward inclines both when said arm elements shoulders lie against said catch shoulders and when said latch arm shoulders lie above said catch shoulder, and downward movement of said beam causes said beam to hit said plug connector upper surface, so said connectors can be released by merely pushing down said beam against said surface.

5. An electrical connector comprising:

a connector body having a front end for mating to another connector, said body having laterally opposite sides, and said connector body having upper and lower surfaces;

a latch device which includes a pair of latch arms lying beyond said opposite sides of said body, said latch arms having front ends with latch shoulders and said rear arms having rear ends and a middle with said middle pivotally connected to said body about a laterally-extending axis, said latch device including a laterally-extending beam lying over said body upper surface and connected to said latch arm rear ends, said latch device being pivotable between a latched position wherein s aid beam lies above said body upper surface and an unlatched position wherein said beam lies against said body upper surface;

in both said initial position and said unlatched position, said arms extend at downward and forward inclines, whereby said beam always lies closely over said body upper surface.

* * * * *